US005483716A

United States Patent [19]

Burnaman

[11] Patent Number: 5,483,716

[45] Date of Patent: Jan. 16, 1996

[54] FORM DECKING APPARATUS FOR BRIDGES

[76] Inventor: Earl W. Burnaman, Rte. 1, Box 508, Deville, La. 71328

[21] Appl. No.: 219,310

[22] Filed: Mar. 28, 1994

[51] Int. Cl.[6] ..... E04G 9/06

[52] U.S. Cl. ..... 14/73; 249/192

[58] Field of Search ..... 14/73, 73.1, 77.1; 249/192, 196, 29

[56] References Cited

U.S. PATENT DOCUMENTS

| | | | |
|---|---|---|---|
| 3,253,288 | 5/1966 | Nagin | 14/73 |
| 3,311,939 | 4/1967 | Yamamoto et al. | 14/73 |
| 5,109,092 | 4/1992 | Salas | 249/192 |

*Primary Examiner*—William P. Neuder

*Attorney, Agent, or Firm*—John M. Harrison

[57] ABSTRACT

A form decking apparatus for use in paving concrete decking on bridges, which apparatus includes multiple elongated form channels oriented on conventional, adjustable cross supports or "whalers" extending between concrete or steel bridge beams, with T-plates spanning the spaces between the form channels to facilitate pouring concrete on the T-plates and form channels. In a preferred embodiment the form channels are deployed on the whalers by means of roller assemblies bolted to the whalers to facilitate minimum risk in traversing the beams and whalers by workmen. In another preferred embodiment of the invention each of the form channels is fitted with a pair of form release bolts which thread into corresponding release nuts welded to the form channels, to release the form channels and the T-plates from the poured and cured concrete decking on the bridge when the whalers are adjusted away from the form channels.

16 Claims, 3 Drawing Sheets

FORM DECKING APPARATUS FOR BRIDGES

BACKGROUND OF THE INVENTION

1. Field the Invention

This invention relates to concrete decking on bridges and more particularly, to a form decking apparatus for removably mounting on adjustable "whalers"or stringers extending between the concrete or steel beams of a bridge structure to facilitate pouring concrete decking on the bridge in a safe, quick and efficient manner. In a preferred embodiment elongated form channels are deployed on the whalers in side-by-side and end-to-end relationship and T-plates are used to cover the spaces between the form channels. In a most preferred embodiment each form channel is further provided with a pair of form release bolts for removing the form channels and the T-plates from the underside of the cured concrete decking when the bridge is completed and the whalers are adjusted downwardly. In yet another preferred embodiment of the invention the form channels are connected end-to-end by slide connectors and are deployed on the whalers or cross supports by means of roller assemblies which are temporarily bolted to the whalers to minimize the risk normally involved when workers traverse the concrete or steel beams and whalers to install plywood on the whalers.

2. Description of the Prior Art

Concrete decking is typically poured on bridges by initially positioning concrete or steel beams on pilings or other supports to span the river, stream, highway, rail road track or other obstacle. Cross-members, commonly called "whalers" are adjustably positioned between the concrete beams at spaced intervals by means of U-bolts spanning the concrete or steel beams and plywood decking is nailed or otherwise attached to the whalers or to spacers positioned on the whalers to provide a support or form at a selected level determined by adjustment of the whalers, for the concrete poured on the bridge to define the bridge decking. After the concrete decking is cured, the plywood forms and spacers are commonly laboriously removed at great expense from the bridge decking. The positioning of the typically 4 ft.×8 ft. plywood sheets and spacers on the whalers between the concrete or steel beams before pouring of the concrete is also hazardous to the workers, since the workers must traverse the whalers and the beams to both position and fasten the plywood panels in place. This job is both dangerous and time-consuming and results in a considerable delay in completing the highway or road system, of which the bridge is an integral part.

Accordingly, it is an object of this invention to provide a new and improved form decking apparatus for temporarily mounting on conventional, adjustable whalers or supports between the beams of bridges to support the concrete decking.

Another object of this invention is to provide a new and improved form decking apparatus for bridges, which includes multiple elongated form channels deployed on the conventional, adjustable cross members or "whalers" mounted by means of U-bolts between the concrete or steel beams of the bridge structure, along with T-plates for bridging the gaps between the form channels, such that the T-plates and form channels define a pouring form for receiving wet concrete which ultimately cures to define the bridge decking.

Yet another object of this invention is to provide a new and improved form decking apparatus for positioning on the conventional whalers extending transversely between the concrete or steel beams of a bridge structure, which form channels include elongated channel plates and channel flanges slidably connected in end-to-end relationship by slide connectors for deployment on the whalers, along with T-plates positioned in the spaces between the form channels to provide a form for receiving poured concrete which defines the bridge decking when cured.

Still another object of this invention is to provide a form decking apparatus for bridges, which form decking apparatus includes multiple, elongated form channels provided with channel flanges for receiving slide connectors that join respective form channels together end-to-end, with form release bolts provided in each form channel, wherein the form channels are deployed in side-by-side and end-to-end relationship on conventional, adjustable whalers transversely mounted by U-bolts on concrete or steel beams in the bridge structure. T-plates are inserted in the cracks or spaces between the form channels such that wet concrete can be poured on the form channels and T-plates and allowed to cure to define the concrete decking on the bridge and the form channels and T-plates are removed from the bottom of the decking by manipulation of the form release bolts after the whalers are loosened from the concrete or steel beams and lowered.

SUMMARY OF THE INVENTION

These and other objects of the invention are provided in a new and improved form decking apparatus for mounting on the conventional cross-members or whalers transversely and adjustably attached to concrete or steel beams on a bridge structure, which form decking apparatus includes multiple elongated form channels connected in end-to-end lengths by slide connectors and fitted with form release bolts and further including roller assemblies temporarily mounted on the whalers to receive and deploy the form channels on the whalers in side-by-side sets. Accordingly, in a preferred embodiment of the invention selected lengths of the form channels are connected end-to-end by means of the slide connectors and deployed on the whalers in side-by-side relationship with respect to each other, using the roller assemblies. T-plates are then inserted in the longitudinal spaces between the form channels, the roller assemblies are removed and additional form channels and T-plates are positioned in the spaces formerly occupied by the roller assemblies. Concrete is then poured on the form channels and T-plates and when the concrete is cured into a monolithic bridge decking, the form channels and T-plates are removed by adjusting the whalers with respect to the concrete or steel beams and the form channels and manipulating the form release bolts in the respective form channels.

BRIEF DESCRIPTION OF THE DRAWINGS

The invention will be better understood by reference to the accompanying drawings, wherein.

DESCRIPTION OF THE PREFERRED EMBODIMENTS

Figures 1, 4:
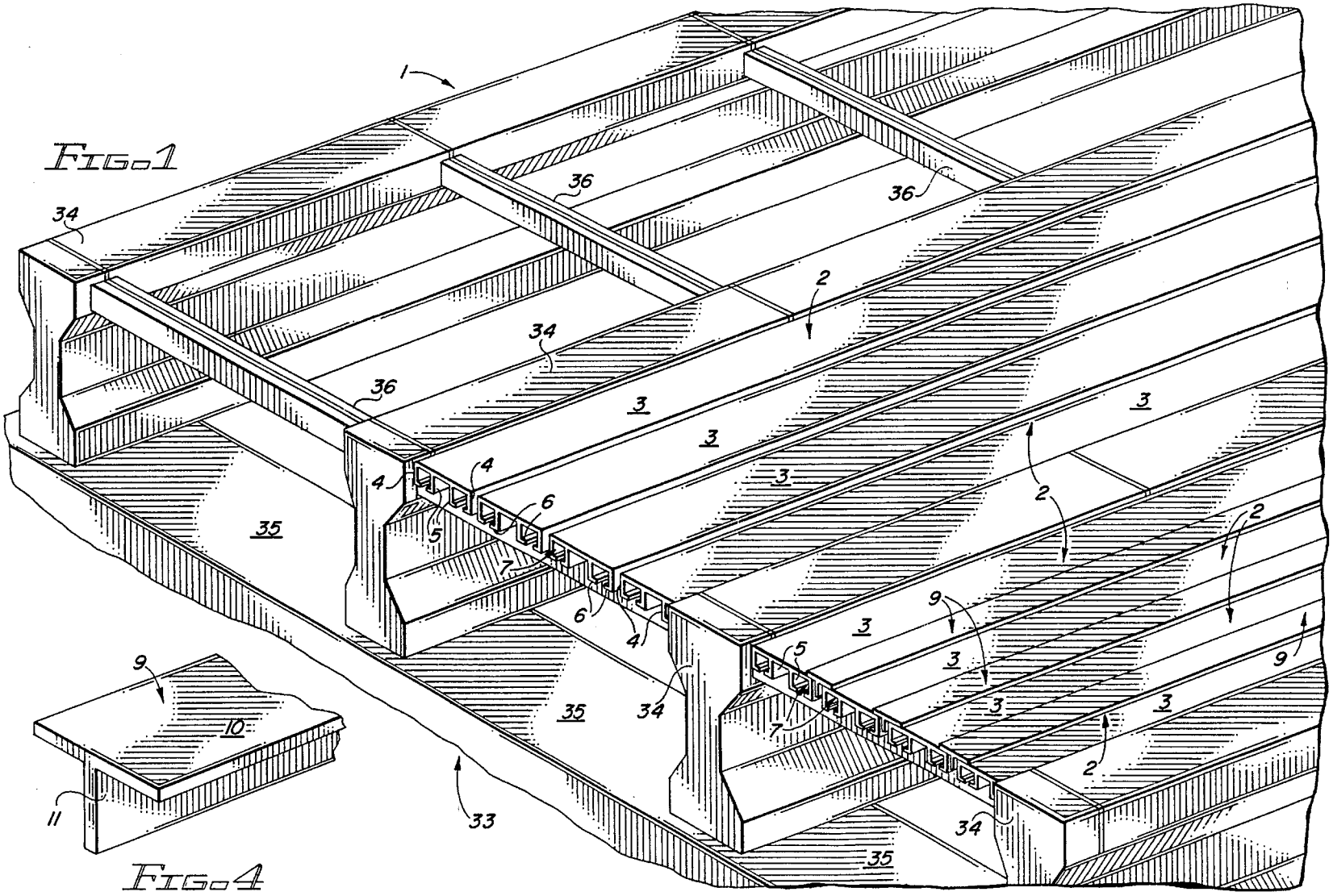
FIG. 1 is a perspective view of a preferred sequential mounting of the form decking apparatus of this invention on a typical bridge structure having three bays and constructed of parallel concrete beams resting on beam supports, with adjustable whalers attached to the Concrete beams in the respective bays.
FIG. 4 is a perspective view, partially in section, of a typical T-plate used to span the longitudinal spaces between the respective rows of form channels the form decking apparatus as the rows of form channels are deployed on the adjustable whalers in the bridge structure.
Figures 2, 3, 5, 6, 7:
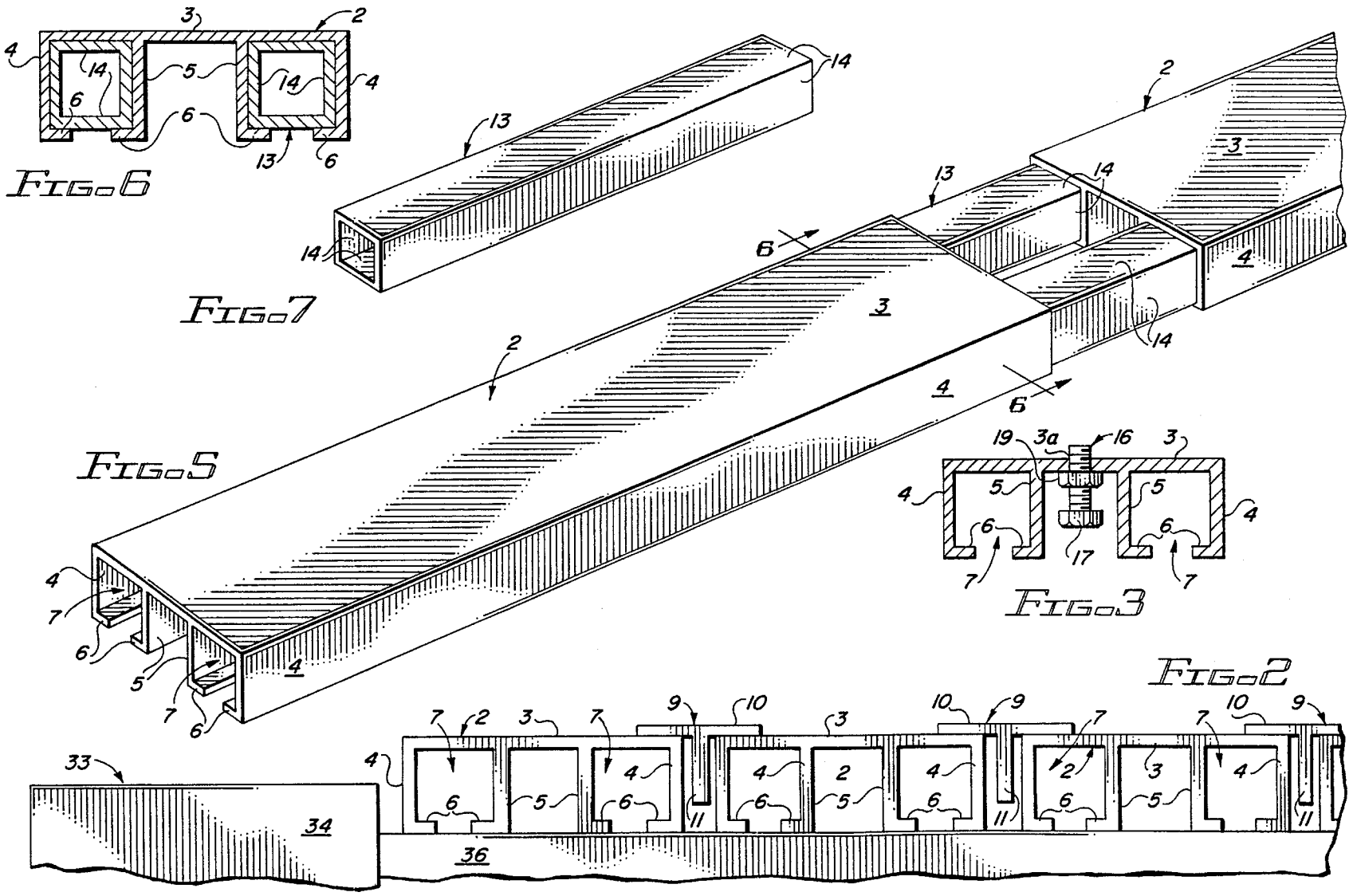
FIG. 2 is an end view of three rows of the form decking apparatus illustrated in FIG. 1.
FIG 3 is an end view of a preferred embodiment of a typical form channel element of the form decking apparatus of this invention, more particularly illustrating a form release bolt element therein.
FIG. 5 is a perspective view, partially in section, of a typical pair of form channels connected end-to-end by a pair of slide connectors.
FIG. 6 is a sectional view taken along line 6—6 of the form channels and slide connectors illustrated in FIG. 5.
FIG. 7 is a perspective view of a typical slide connector used to connect the form channels to each other as illustrated in FIG. 5.
Figure 8:
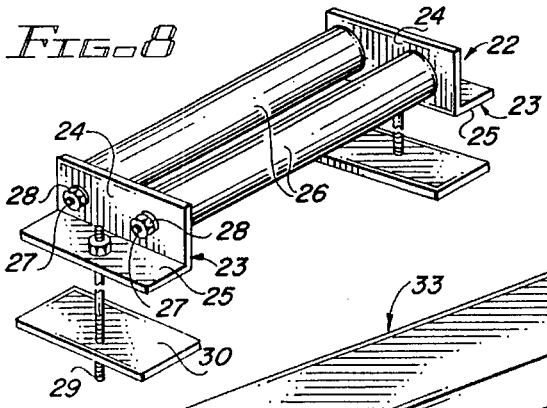
FIG. 8 is a perspective view of a typical roller assembly used to deploy the form channels on the bridge structure.

Referring initially to FIGS. 1 and 2 of the drawings, in a first preferred embodiment, the form decking apparatus of this invention is generally illustrated by reference numeral 1. The form decking apparatus 1 is illustrated in functional position on spaced, adjustable whalers 36, which span parallel concrete beams 34, resting on beam supports 35 of a bridge structure 33. For purposes of illustration, the bridge structure 33 is characterized by a first span or bay between concrete beams 34, illustrating whalers 36 in spaced relationship with respect to each other, without application of the form decking apparatus 1. The whalers 36 are typically attached to the concrete beams 34 by means of U-bolts (not illustrated) to facilitate conventional adjustment of the whalers 36 with respect to the concrete beams 34. In the second span or bay of the bridge structure 33 illustrated from left to right in FIG. 1 between parallel, spaced concrete beams 34, multiple rows of form channels 2 are deployed on the respective whalers 36 in spaced relationship with respect to each other. T-plates 9 can then be deployed in the longitudinal spaces between the form channels 2, shown in the third span or bay of the bridge structure 33, illustrated in FIG. 1. Accordingly, it will be appreciated from a consideration of the third bay of the bridge structure 33 wherein the T-plates 9 are in position between the respective form channels 2, that concrete may be poured on the form channels 2 and the T-plates 9, with the latter acting as a form and support for the wet concrete to define a curved concrete bridge decking (not illustrated).

Referring now to FIGS. 5–7 of the drawings, in a preferred embodiment of the invention each of the form channels 2 is characterized by a flat channel plate 3 fitted with downwardly-extending outside channel flanges 4 and inside channel flanges 5, each having inwardly-facing flange fingers 6, respectively. The outside channel flanges 4, inside channel flanges 5 and the respective flange fingers 6 define adjacent slide connector openings 7 for receiving box tubing slide connectors 13, shaped from flat connector plates 14. In a most preferred embodiment of the invention the connector plates 14 are equal in width to define a slide connector 13 which is square in cross-sectional configuration. The slide connectors 13 are slightly smaller in dimension than the slide connector openings 7 to facilitate slidable insertion of the respective slide connectors 13 in the respective aligned ends of adjacent form channels 2 and slidably connecting one or more pairs of form channels 2 in linear relationship as illustrated in FIG. 5, for purposes which will be hereinafter further described. Accordingly, selected lengths or rows of form channels 2 are connected by means of the slide connectors 13 before the form channels 2 are positioned on the respective whalers 36 of the bridge structure 33 between the concrete beams 34, as illustrated in FIG. 4.

As further illustrated in FIGS. 1, 2 and 4 of the drawings, in a preferred embodiment of the invention the T-plates 9 are each characterized by a flat plate flange 10 having a web 11 projecting along the length thereof for insertion in the longitudinal spaces between the respective form channels 2, as illustrated in FIGS. 1 and 2. Accordingly, it will be appreciated from a further consideration of FIG. 1 that rows of the slidably-connected form channels 2 can be deployed in closely spaced relationship with respect to each other on the respective whalers 36 and the T-plates 9 then deployed as illustrated in FIGS. 1 and 2. Alternatively, a single T-plate 9 can be used to bridge a single gap between adjacent rows of the form channels 2 when the form channels 2 are forced together by a spacer block of selected width. This expedient reduces the number of T-plates 9 which are required.

Figure 9:
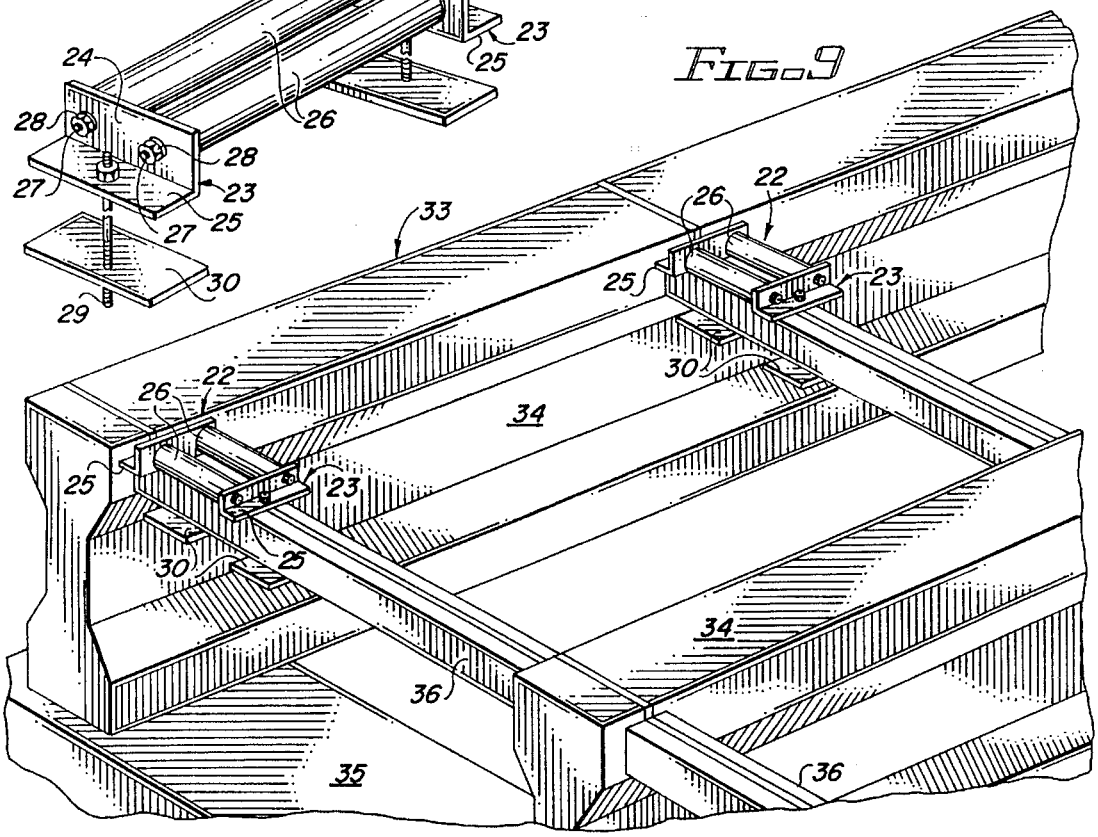
FIG. 9 is a perspective view, partially in section, of a typical installation of multiple units of the roller assembly illustrated in FIG. 8.
Figure 10:
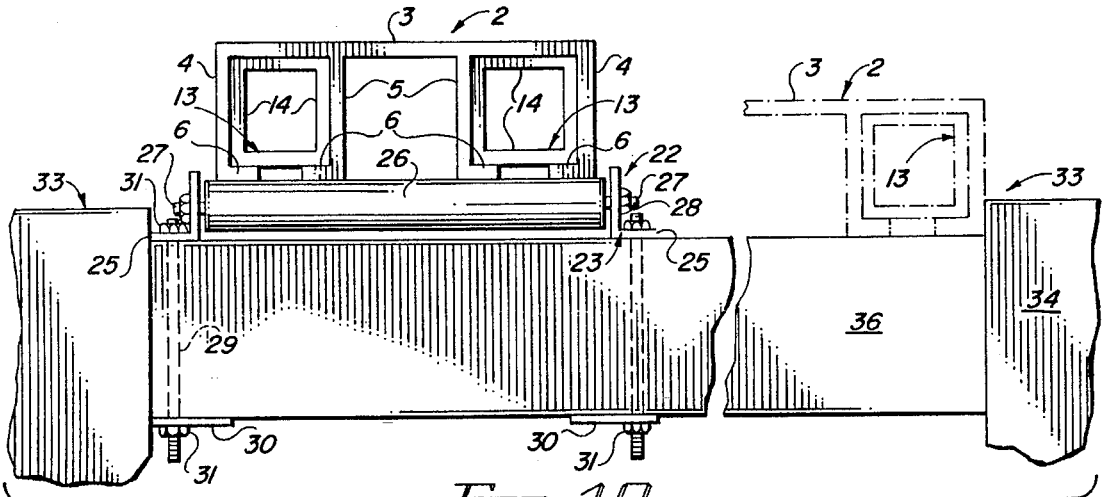
FIG. 10 is an end view of one of the roller assemblies illustrated in FIG. 9, with a pair of form channels connected end-to-end by slide connectors and positioned on the roller assembly for deployment on the whalers of the bridge structure.
Figure 11:
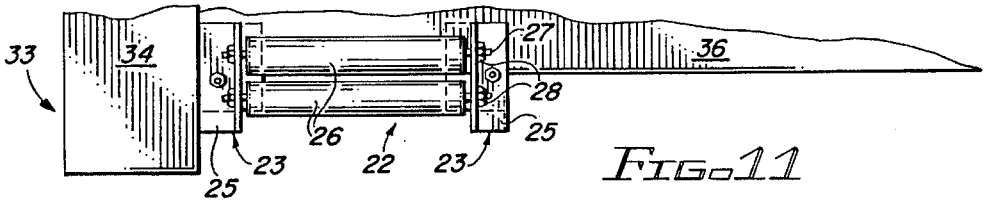
FIG. 11 is a top view, partially in section, of a roller assembly illustrated in FIGS. 8–10.

As illustrated in FIGS. 8–11, in another preferred embodiment of the invention multiple roller assemblies 22 are bolted in position on the whalers 36 using assembly studs 29, mount plates 30 and assembly stud nuts 31, respectively. The respective slidably-connected form channels 2 may then be rolled in sequence down the roller assemblies 22 on the respective rollers 26, which are rotatably positioned in spaced, parallel roller mount flanges 24 of roller brackets 23 by means of roller pins 27 and pin nuts 28. Subsequently, the respective rows of slidably-connected form channels 2 may be moved laterally from the rollers 26 to the respective whalers 36 adjacent to the roller assemblies 22, as illustrated in phantom in FIG. 10. In a preferred embodiment of the invention each of the roller brackets 23 is characterized by a roller mount flange 24, through which the roller pins 27 extend and an assembly mount flange 25 extending from the roller mount flange 24, for receiving the assembly studs 29 and securing the assembly mount plate 30 to the bottom of each of the respective whalers 36, as illustrated in FIGS. 9–11.

It will be appreciated by those skilled in the art that the form decking apparatus 1 of this invention may be applied to substantially any bridge structure 33 which is constructed of concrete, steel or other types of beams 34, beam supports 35 and adjustable cross-supports, beams or whalers 36. The form decking apparatus 1 can be applied to any such bridge structure 33 to replace plywood panels and spacers conventionally used to mount on the whalers 36 as a form for supporting the concrete decking. Furthermore, the respective elements of the form decking apparatus 1, that is, the form channels 2, slide connectors 13 and roller assemblies 22, can be constructed of any desired size and material, including aluminum, plastic or other durable, lightweight material. These elements can also be reused as often as desired, since the respective form channels 2 can be quickly and easily removed, along with the T-plates 9, from the poured and cured concrete bridge decking by operation of the form release bolts 16 after the whalers 36 have been loosened from the concrete beams 34. Moreover, it will be appreciated by those skilled in the art that the respective form channels 2 may shift with shrinkage of the concrete decking by operation of the slide connectors 13 to relieve structural stresses which may build up in the form decking apparatus 1 as the concrete decking cures. The connection between the form channels 2 by operation of the slide connectors 13 as illustrated in FIG. 5, also facilitates more precise adjustment of the form channels 2 across the respective whalers 36, under circumstances where the whalers 36 may not be equally spaced between the concrete beams 34 for structural reasons.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A form decking apparatus for mounting on bridge structures and supporting concrete poured on the bridge structures, said form decking apparatus comprising a plurality of form channels positioned on the bridge structures; a plurality of T-plates positioned longitudinally between said form channels and lapping at Least a longitudinal portion of adjacent ones of said form channels, for receiving and supporting the concrete on the bridge structures; and release means provided on said form channels for removing said form channels and said T-plates from the bridge structures when the concrete poured on said form channels and said T-plates has cured.

2. The form decking apparatus of claim 1 comprising at least one slide connector slidably engaging and connecting selected ones of said form channels in longitudinal end-to-end relationship with respect to each other.

3. The form decking apparatus of claim 1 wherein said release means comprises at least one release nut fixedly secured to each of said form channels; an opening provided in each of said form channels in alignment with the threads of said release nut; and at least one release bolt having a threaded end threaded in said release nut, with said threaded end of said release bolt aligned with said opening in each of said form channels, respectively, whereby said threaded end of said release bolt may be threadably advanced through said release nut and said opening for engagement with the concrete on said form channels and said T-plates, to release said form channels and said T-plates from the concrete.

4. The form decking apparatus of claim 3 wherein said at least one release nut comprises a pair of release nuts fixedly attached to said form channel and said at least one release bolt comprises respectively.

5. The form decking apparatus of claim 3 comprising at least one slide connector slidably engaging and connecting selected ones of said form channels in longitudinal end-to-end relationship with respect to each other.

6. The form decking apparatus of claim 5 wherein said at least one release nut comprises a pair of release nuts fixedly attached to said form channel in spaced relationship with respect to each other and said at least one release bolt comprises a pair of release bolts threaded in said release nuts, respectively.

7. The form decking apparatus of claim 2 comprising roller means positioned on the bridge structures for receiving said form channels and deploying said form channels on the bridge structures.

8. The form decking apparatus of claim 7 comprising at least one slide connector slidably engaging and connecting selected ones of said form channels in longitudinal end-to-end relationship with respect to each other.

9. The form decking apparatus of claim 8 wherein said release means comprises at least one release nut fixedly secured to each of said form channels; an opening provided in each of said form channels in alignment with the threads of said release nut; and at least one release bolt having a threaded end threaded in said release nut, with said threaded end of said release bolt aligned with said opening in each of said form channels, respectively, whereby said threaded end of said release bolt may be threadably advanced through said release nut and said opening for engagement with the concrete on said form channels and said T-plates, to release said form channels and said T-plates from the concrete.

10. The form decking apparatus of claim 9 wherein said at least one release nut comprises a pair of release nuts fixedly attached to said form channel in spaced relationship with respect to each other and said at least one release bolt comprises a pair of release bolts threaded in said release nuts, respectively.

11. A form decking apparatus for removably mounting on the adjustable whalers of bridge structures and supporting concrete poured on the bridge structures, comprising a plurality of form channels, each of said form channels characterized by an elongated channel plate with outside and inside channel flanges extending from said channel plate to define at least one longitudinal slide connector opening and first selected ones of said form channels disposed on the whalers in side-by-side relationship with respect to each other; at least one slide connector slidably disposed in longitudinally facing ones of said slide connector opening in second selected ones of said form channels disposed in end-to-end relationship with respect to each other; at least one release means provided on said channel late of each of said form channels for releasing said form channels from the concrete when the concrete has cured; and a plurality of T-plates, each of said T-plates characterized by a web for insertion between said channel plate and said outside channel flanges, respectively, of said first selected ones of said form channels and a plate flange capping said web in perpendicular relationship with respect to said web, said plate flange overlapping the outside longitudinal edges of said channel plate of said first selected ones of said form channels, whereby said channel plate of said form channels and said plate flange of said T-plates define a form for supporting the concrete poured on the bridge structures.

12. The form decking apparatus of claim 11 wherein said at least one slide connector opening comprises a pair of slide connector openings and said at least one slide connector comprises a pair of slide connectors slidably disposed in said slide connector openings, respectively.

13. The form decking apparatus of claim 11 wherein said release means comprises at least one release nut fixedly secured to each of said form channels; an opening provided in each of said form channels in alignment with the threads of said release nut; and at least one release bolt having a threaded end threaded in said release nut, with said threaded end of said release bolt aligned with said opening in each of said form channels, respectively, whereby said threaded end of said release bolt may be threadably advanced through said release nut and said opening for engagement with the concrete on said form channels and said T-plates, to release said form channels and said T-plates from the concrete.

14. The form decking apparatus of claim 13 wherein said at least one release nut comprises a pair of release nuts fixedly attached to said form channel in spaced relationship with respect to each other and said at least one release bolt comprises a pair of release bolts threaded in said release nuts, respectively.

15. The form decking apparatus of claim 14 wherein said at least one slide connector opening comprises a pair of slide connector openings and said at least one slide connector comprises a pair of slide connectors slidably disposed in said slide connector openings, respectively.

16. The form decking apparatus of claim 15 comprising roller means positioned on the bridge structures for receiving said form channels and deploying said form channels on the bridge structures.

* * * * *